United States Patent [19]

Clavel

[11] 4,344,714

[45] Aug. 17, 1982

[54] DEVICE FOR POSITIONING THE BEGINNING OF A LINE IN A TYPEWRITER

[75] Inventor: Raymond Clavel, Yverdon, Switzerland

[73] Assignee: Hermes Precisa International S.A., Yverdon, Switzerland

[21] Appl. No.: 165,130

[22] PCT Filed: Feb. 6, 1979

[86] PCT No.: PCT/CH79/00017

§ 371 Date: Oct. 7, 1979

§ 102(e) Date: Sep. 7, 1979

[87] PCT Pub. No.: W079/00599

PCT Pub. Date: Aug. 23, 1979

[30] Foreign Application Priority Data

Feb. 7, 1978 [CH] Switzerland ..... 1326/78

[51] Int. Cl.[3] ..... B41J 19/66

[52] U.S. Cl. ..... 400/334.3; 400/329.1; 400/345

[58] Field of Search ..... 400/291, 317, 317.1, 400/317.2, 317.3, 314.2, 314.3, 320, 332, 332.6, 333, 334, 334.1, 334.2, 334.3, 341, 344, 345, 346, 348, 329.1, 342

[56] References Cited

U.S. PATENT DOCUMENTS

| | | | |
|---|---|---|---|
| 1,955,614 | 4/1934 | Thompson et al. | 400/314.3 |
| 2,872,013 | 2/1959 | Wittwer | 400/317 X |
| 3,126,998 | 3/1964 | Palmer | 400/320 X |
| 3,263,793 | 8/1966 | Brignole, Jr. | 400/314.2 |
| 3,441,119 | 4/1969 | Schweizer | 400/334.3 X |
| 3,572,487 | 3/1971 | Rolph et al. | 400/317.2 X |
| 3,625,332 | 12/1971 | McGrath | 400/314.2 X |
| 3,752,289 | 8/1973 | Link | 400/334.3 X |
| 3,978,967 | 9/1976 | Gagnebin | 400/334.3 X |

FOREIGN PATENT DOCUMENTS

| | | |
|---|---|---|
| 1381191 | 10/1964 | France . |
| 1445053 | 5/1966 | France . |
| 880704 | 10/1961 | United Kingdom . |

*Primary Examiner*—Ernest T. Wright, Jr.

[57] ABSTRACT

A device for positioning the beginning of the line in a typewriting machine of the kind with a typing element carried by a carriage (1) includes at least one margin stop (13) for the carriage (1). This margin stop (13) is fixed on a mounted margin rack (19) sliding against the action of a spring (24). An escapement pawl (5), working with a rack bar (10), is carried by the carriage (1). A universal bar (11) disengages the pawl (5) from the rack bar (10) at the time of the return of the carriage (1) and frees the pawl (5) at the end of its path. In order to avoid a situation where the pawl (5) falls in a displaced notch of the rack bar (10), the device is in addition supplied with means for locking the pawl (5) in a disengaged position relative to the rack bar (10) during the movement of the sliding margin rack (19).

3 Claims, 1 Drawing Figure

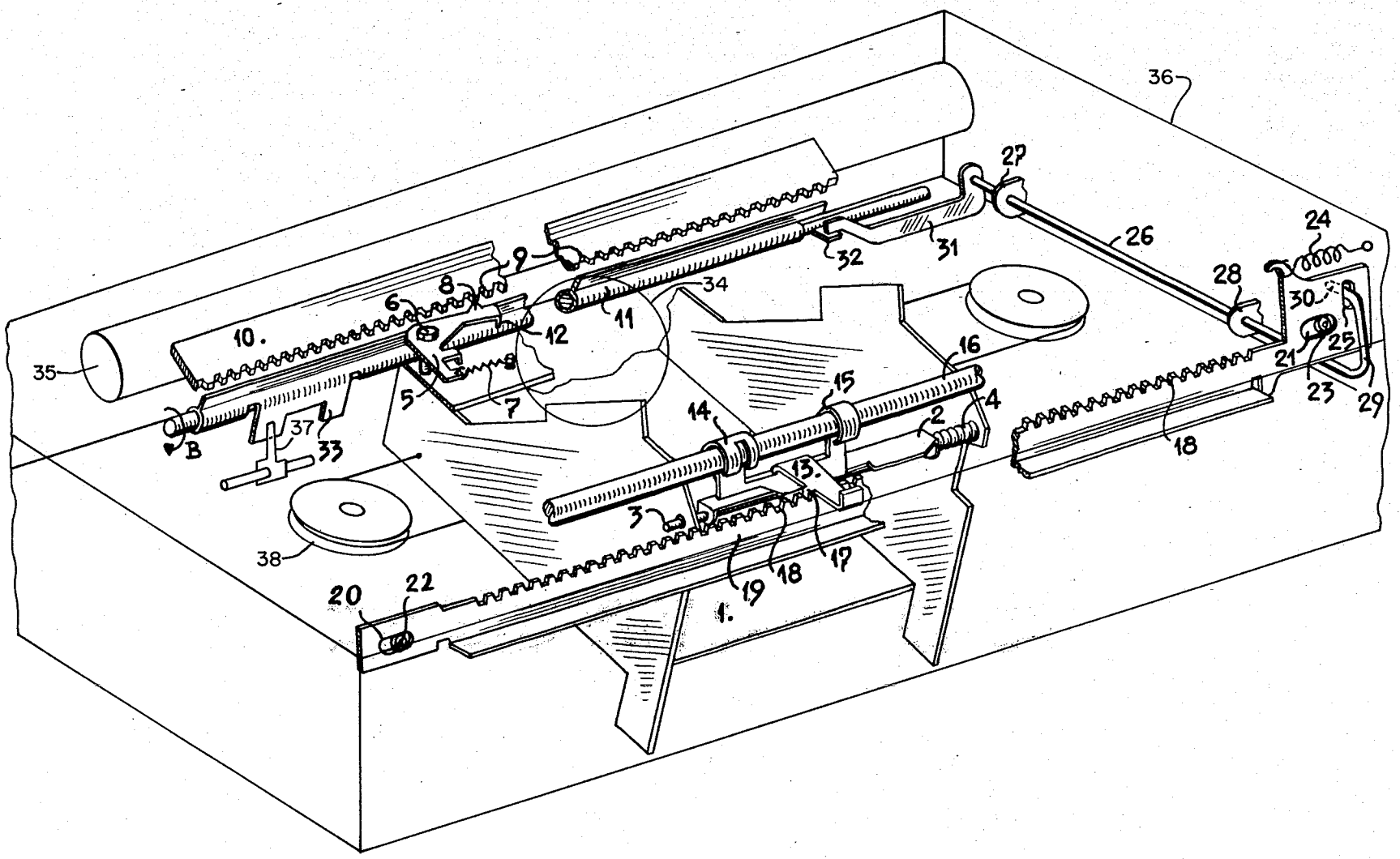
36
24
30
25
29
23
21
28
26
27
18
31
32
16
4
2
15
13
17
18
19
1
34
14
3
11
12
9
8
7
6
5
22
20
33
37
38
10
B
35

DEVICE FOR POSITIONING THE BEGINNING OF A LINE IN A TYPEWRITER

The present invention concerns a device for positioning the beginning of a line in a typewriter of the type which has a type ball carried by a carriage moving parallel to a platen.

Known devices of this kind include at least a margin stop for the carriage capable of being set in position in relation to a margin rack for defining the beginning of the lines of writing. The margin rack is mounted and slidable against the action of an elastic element in a direction parallel to that of the movement of the carriage, with an escapement pawl being carried by the carriage and working with a fixed rack bar and a universal bar which ensures that the pawl is kept in a disengaged position relative to the rack bar during the return of the carriage to the beginning of the line.

At the end of the line, in order to pass to the following line, the carriage is brought back to position at the beginning of the line by a motor, and the escapement pawl is removed from position on the rack bar by the action of a universal bar, while the platen rotates a space corresponding to the space between the lines. At the end of the return movement, the carriage comes to a stop against the margin stop, which causes a movement of the sliding margin rack on which the margin stop is fixed. The movement of the margin rack in relation to the chassis is used to control the stopping the movement of the carriage and the action of the universal bar acting on the escapement pawl. Because of the presence of an elastic element such as a spring between the sliding margin rack and the chassis of the machine, there may be a sufficient distortion of these elastic elements at the time of impact of the carriage against the margin stop to make the escapement pawl fall back into a notch of the rack bar, the notch being displaced in relation to that which is determined by the position of the margin stop. In the case of a more rigid construction in which the movement of the sliding margin rack is limited at the most to one step of the rack bar, there may be a repeated jump of the carriage also causing a poor position at the beginning of the line of writing.

The invention has for its object assuring the positioning of the first column of writing by the use of parts which are lightweight and thus inexpensive.

The device for positioning the beginning of the line, which is the object of the invention, is characterized by the fact that the sliding margin rack works together with the means for locking the pawl in a disengaged position relative to the rack bar during the movement of said sliding margin rack.

The single FIGURE of the attached drawing shows, schematically, and by way of example, a perspective view of a preferred manner of execution of the device, which is the object of the invention.

A carriage, 1, slides parallel to the axis of a platen 35, and carries a typing 34 ball. It includes a stop, 2, which abuts margin stop 13 to effect sliding of the stop 2 along the length of an axle, 3, against the action of a compression spring, 4. The axle, 3, is secured at each end to lateral walls 1*a* and 1*b* of the carriage, 1. An escapement pawl, 5, is mounted on a pivot, 6, of the carriage 1. A tooth, 8, of the pawl, 5, is engaged under the effect of a traction spring, 7, in the notches, 9, of a rack bar, 10, which is solidly joined to the typewriter.

A universal bar, 11, pivoting around an axis parallel to the platen 35, is capable of working together with a spur, 12, of the pawl, 5.

A margin stop, 13, includes two hooks, 14 and 15, surrounding a shaft, 16, attached to the chassis 36 of the typewriter, and a spur, 17, engaged in one of the notches, 18, of a margin rack, 19. The margin rack, 19, is provided with two oblong holes, 20 and 21, at its ends, through which pass two shafts, 22 and 23, attached to the chassis 36. The margin rack, 19, guided by the shafts, 22 and 23, may slide in a direction parallel to the direction of movement of the carriage, 1, against the action of a spring, 24, attached, on the one hand, to the chassis 36 and, on the other hand, to said margin rack, 19. The margin rack, 19, has in addition an oblong hole, 25, arranged perpendicularly to its direction of movement. A shaft, 26, guided in rotation in two bearings, 27 and 28, which are joined to the chassis 36, is bent back twice at one of its ends to form a lever, 29, having a finger 30 engaged in the oblong hole, 25. A lever, 31, fixed to the other end of the shaft, 26, is capable of working with a flange, 32, fixed radially on the universal bar, 11.

Control of the advance, step by step, of the carriage, 1, is done by means of the universal bar, 11. It is sufficient to cause a momentary rotation of said bar 11 in the direction of arrow B by known means 37 acting on the flange, 33, to disengage the tooth, 8, of the pawl, 5, from a notch, 9, of the rack bar, 10, with the tooth, 8, falling back into another of the notches 9 under the effect of the spring, 7.

For positioning the carriage, 1, at the beginning of a line of writing, the pawl, 5, is disengaged from the rack bar, 10, by acting in a known manner on the flange, 33, and the carriage 1 is pulled toward the left margin by means 38.

In position at the beginning of a line, the carriage, 1, comes to a stop against the margin stop, 13, and, under the effect of the resulting impact, the sliding margin rack, 19, moves in the same direction as the carriage 1 against the action of the spring, 24.

The movement of the sliding margin rack, 19, entails a rotation of the lever, 29, of the shaft, 26, and of the lever, 31. The lever 31 acts on the flange, 32, of the universal bar, 11, to maintain the pawl, 5, disengaged from the rack bar, 10, while the sliding margin rack, 19, has not assumed its initial position.

In practice, it may be noted that the pawl, 5, is kept in a disengaged position while the relative movement is greater than a half-step of the rack bar 10.

I claim:

1. Device for positioning the beginning of the line in a typewriter provided with a typing ball carried by a carriage (1) moving parallel to a platen, including at least a margin stop (13) forming a stop for the carriage (1) and capable of being fixed in position in relation to a margin rack (19) to define the beginning of the lines of writing, said margin rack (19) being mounted on a pair of shafts (22,23) and sliding against the action of an elastic element (24) in a direction parallel to that of the movement of the carriage (1), an escapement pawl being carried by the carriage (1) and engageable with a rack bar (10) which is fixed, means holding the pawl (5) in a disengaged position relative to the rack bar (10) during the return of the carriage (1) to the beginning of the line, characterized by the fact that the margin rack (19) engages with means for locking (11,26,29,31,32) the pawl (5) in a disengaged position relative to the rack bar during the movement of said margin rack (19).

2. Device according to claim 1, wherein said means holding the pawl in a disengaged position includes a universal bar (11) pivotable about an axis parallel to the direction of movement of the carriage (1) and capable of working with a spur (12) of the escapement pawl (5) to disengage said pawl from the rack bar (10), characterized by the fact that the means for locking said pawl comprise a mechanical link between the margin rack (19) and the universal bar (11), said mechanical link causing a pivoting movement of the universal bar (11) at the time of movement of the margin rack (19).

3. Device according to claim 2, characterized by the fact that the mechanical link includes a shaft (26), pivoting around an axis which is substantially orthogonal to the direction of movement of said carriage (1), a pair of levers (29 and 31), connected to said shaft (26) and disposed at opposite ends thereof, one (29) of said levers working with said margin rack (19), the other (31) of said levers acting on a flange (32) of said universal bar (11) whereby a movement of said margin rack (19), against the action of a spring (24) comprising said elastic element, causes a pivoting of the universal bar (11).

* * * * *